United States Patent [19]

Blom

[11] 3,941,419

[45] Mar. 2, 1976

[54] BUCKLE COMPONENT FOR A VEHICLE OCCUPANT RESTRAINT BELT SYSTEM

[75] Inventor: Hubert Peter Blom, Royal Oak, Mich.

[73] Assignee: General Motors Corporation, Detroit, Mich.

[22] Filed: Nov. 21, 1974

[21] Appl. No.: 525,968

[52] U.S. Cl. ..... 297/389; 24/78; 24/193; 24/196; 280/150.5 B; 297/388

[51] Int. Cl.[2]A44B 11/12; A44B 11/25; A62B 35/00

[58] Field of Search ..... 297/389, 388, 385; 24/193, 24/170, 191, 196, 78; 280/150.5 B

[56] References Cited

UNITED STATES PATENTS

| | | | |
|---|---|---|---|
| 3,246,929 | 4/1966 | Taggert | 24/193 X |
| 3,258,293 | 6/1966 | Sharp | 297/389 |
| 3,266,110 | 8/1966 | Davis | 24/193 X |
| 3,289,261 | 12/1966 | Davis | 24/193 |
| 3,324,519 | 1/1967 | Board et al. | 24/191 |
| 3,551,961 | 1/1971 | Nvgren | 24/196 |
| 3,646,644 | 3/1972 | Watts | 24/170 |
| 3,847,434 | 11/1974 | Wemen | 297/388 |

*Primary Examiner*—James T. McCall
*Attorney, Agent, or Firm*—H. Furman

[57] ABSTRACT

A buckle component of a vehicle occupant restraint belt system is slidably disposed on a restraint belt of the system in an improved manner. The buckle component may take the form of a female buckle or a male D-ring that secures the belt in an occupant restraining position. The buckle component includes a housing with an outwardly facing rectilinear locking portion extending transversely with respect to the elongated direction of the belt. An external lock bar extends alongside the locking portion with the belt received therebetween. The lock bar has a slightly greater length than the width of the belt and has end portions extending about the side edges of the belt and back toward each other in generally U-shaped configurations. These end portions are pivotally mounted on the housing of the buckle component. When the buckle component secures the belt in an occupant restraining position, two sides of the belt extend from the lock bar alongside each other and a manually applied tension on one of these sides pivots the lock bar away from the locking portion to permit sliding adjustment of the belt through the buckle component so that the other side is tensioned. This tensioning of the other side of the belt pivots the lock bar toward the locking portion and clamps the belt against the locking portion so that the buckle component is located along the belt and enables the belt to provide its occupant restraining function. The buckle component may be used in the restraint belt system to define the belt into angularly disposed lap and shoulder belt portions. Due to the external condition of the lock bar, the width of the housing may be the same as or less than the width of the belt, and the angularly disposed lap and shoulder belt portions may extend from their common juncture at the lock bar with rectilinear configurations.

2 Claims, 7 Drawing Figures

BUCKLE COMPONENT FOR A VEHICLE OCCUPANT RESTRAINT BELT SYSTEM

BACKGROUND OF THE INVENTION

This invention relates generally to a vehicle occupant restraint belt system, and more particularly toward an improved buckle component that is slidably disposed along a belt of the system and used to secure the belt in an occupant restraining position.

Buckle components have been utilized for quite some time to secure restraint belts of vehicle occupant restraint belt systems in occupant restraining positions. These buckle components may take the form of a female buckle or a male latch plate which is generally referred to as a D-ring since it has an aperture that gives the plate a configuration much like the configuration of the capital letter D. A female buckle receives and attaches a complementary male D-ring to provide securement of one or more belts attached to either or both of the buckle components. The buckle components may be attached to the respective end portions of a pair of belts so that after attachment these two belts provide a continuous belt loop that encircles a vehicle occupant. Likewise, as shown by the U.S. Pat. No. 2,710,649 of Griswold II et al, the buckle component may be located intermediate the ends of a single belt so that the belt provides both lap and shoulder belt portions, with the buckle component being attachable to another belt portion to provide a second lap belt portion that cooperates with the first in what is generally referred to as a three-point belt system. The U.S. Pat. No. 3,258,293 of Sharp shows a belt system similar to the Griswold system in which the buckle component is also positioned along an intermediate portion of a belt to provide lap and shoulder belt portions.

The main structural component of these buckle components are referred to as housings whether they are of the female buckle or male D-ring type. The buckle component housing of the male D-rings may also be referred to as latch plates. In the past, both of these types of buckle components have been secured to their associated restraint belts in an adjustable manner by the use of lock bars. These lock bars have elongated configurations approximately equal to the width of their associated belts and have their end portions slidably mounted within slots in portions of the buckle component housing at each of the ends of the lock bar. This necessarily means that the width of the buckle component must be somewhat greater than the width of the belt in order that the length of the lock bar can accommodate the total width of the belt. The belt is looped over the lock bar so that tension on the portion of the belt which provides an occupant restraining function causes the lock bar to move the belt against a locking portion of the buckle component and thereby to clamp the belt against sliding over the lock bar. A manual pull exerted on the other portion of the belt pulls the lock bar away from the locking portion so that the buckle component may be adjusted along the belt.

SUMMARY OF THE INVENTION

The present invention provides a vehicle occupant restraint belt system having an improved buckle component that is slidably disposed along a belt of the system.

An important object of the present invention is to provide a restraint belt buckle component in which the buckle component housing has a width approximately equal to or less than the width of the associated restraint belt.

In carrying out this object and other objects of this invention, the belt buckle component of the invention utilizes an "external" lock bar that differs from the "internal" type of lock bar that has been utilized in the past. The housing of this buckle component does not have portions that are located outwardly of the side edges of the belt in order to support the ends of the lock bar. Rather, the buckle component housing has an outwardly facing surface that provides a locking portion extending transversely with respect to the width of the belt and the lock bar has a rectilinear confiiguration running alongside this locking portion with the belt slidably located therebetween, and the ends of the lock bar extend about the side edges of the belt back toward each other so as to be supported by the housing. The housing thus does not have to be wider than the belt to accomodate the full width of the belt and the belt portions which extend from the lock bar may be angularly disposed with respect to each other and extend from the lock bar with rectilinear configurations, such as when the buckle is utilized to define the juncture between lap and shoulder belt portions. Preferably, when so used, a shoulder belt retractor windingly receives the shoulder belt portion of the belt on a belt reel that is spring biased to a wound condition. This spring bias maintains the shoulder belt taut during use. A manual tension applied to the shoulder belt portion when it is attached in place across a user causes the lock bar to move away from the locking portion of the buckle component housing so the buckle component may be adjusted along the belt to provide tension in the lap belt portion. This lap belt tension moves the lock bar in the opposite direction toward the locking portion of the buckle component housing so as to clamp the juncture of the lap and shoulder belt portions and thereby locate the buckle component along the belt. When the buckle component is utilized at the terminal end of a restraint belt, the end portion of the belt is looped through the lock bar and is secured to a slide on the belt such that the size of the loop thus formed determines the effective length of the belt.

BRIEF DESCRIPTION OF THE DRAWINGS

The above specified object and other objects, features and advantages of the present invention are readily apparent from the following detailed description of the preferred embodiments and the drawings in which.

DETAILED DESCRIPTION OF THE PREFERRED EMBODIMENTS

Figure 1:
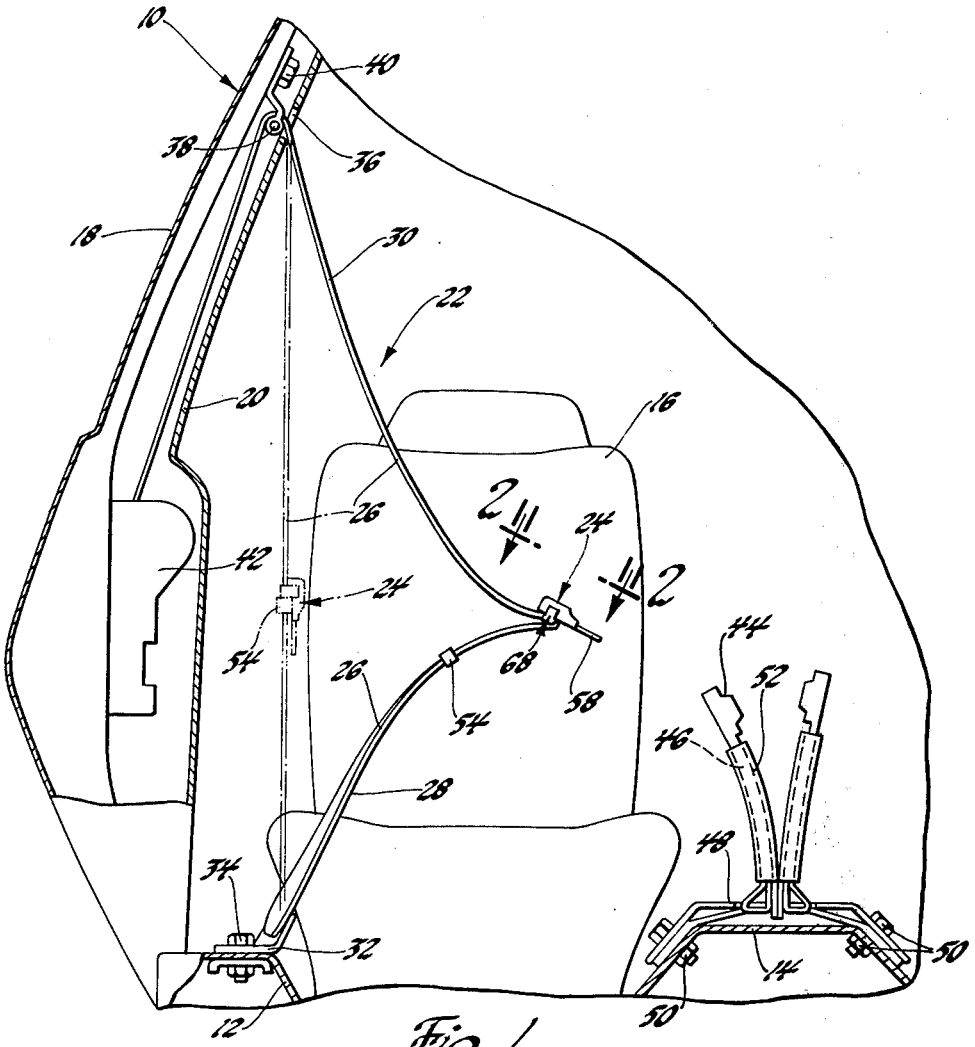
FIG. 1 is a longitudinal sectional view taken through a vehicle having an occupant restraint belt system including an improved buckle component, according to this invention, which defines the juncture between lap and shoulder belt portions of the belt system.

Referring generally to FIG. 1, a vehicle is generally indicated by numeral 10 and includes a floor 12 including a central transmission tunnel 14 located inboard of a passenger seat 16. A side pillar 18 extends vertically adjacent the rear end of the seat outboard thereof and includes a trim panel 20 facing to within the passenger compartment of the vehicle.

An occupant restraint belt system of the vehicle is generally indicated by numeral 22 and utilizes an improved buckle component of this invention indicated generally by 24. Belt system 22 includes a belt 26 along which the buckle component 24 is slidably disposed to define a lap belt portion 28 and a shoulder belt portion 30. The lap belt portion 28 has a lower end suitably secured to an attachment plate 32 and this plate is secured to the floor 12 outboard of the seat 16 by a nut and bolt arrangement 34. The upper end of the shoulder belt extends through an aperture 36 in the trim panel 20 of pillar 18 and over a slide 38 that is secured to the pillar 18 by a bolt 40. The shoulder belt portion 30 extends downwardly from slide 38 to a belt retractor 42 that is suitably mounted on the pillar 18 and hidden from sight by the trim panel 20. Inboard of the seat 16, the belt system 22 includes a female buckle 44 that is secured to the upper end of a belt 46. The lower end of belt 46 is looped through a plate arrangement 48 that is secured to the transmission tunnel 14 by nut and bolt arrangements 50. Belt 46 is encircled by a plastic sleeve 52 so that the belt has a semirigid nature and positions the buckle upwardly where it is conveniently accessible to an occupant of seat 16. A belt system symmetrical to belt system 22 may also be provided on the opposite side of transmission tunnel 14 as is suggested by the unnumbered buckle and sleeve also shown secured to the transmission tunnel.

The belt retractor 42 includes a belt reel, not shown, that is spring biased so as to normally bias the belt to a wound condition. This reel thus normally stores the belt 26 so it extends between the slide 38 and the attachment plate 32 in a vertical rectilinear configuration as shown by phantom lines in FIG. 1. The buckle component 24 slides downwardly when the belt assumes this vertical rectilinear configuration, in a manner that will subsequently become apparent, and a suitable stop 54 disposed along the lap belt portion 28 of the belt limits this downward sliding movement of the buckle component. The buckle component 24 thus is always positioned in the same location for an occupant to grasp it and move the belt to the solid line indicated occupant restraining position of FIG. 1.

Figure 2:
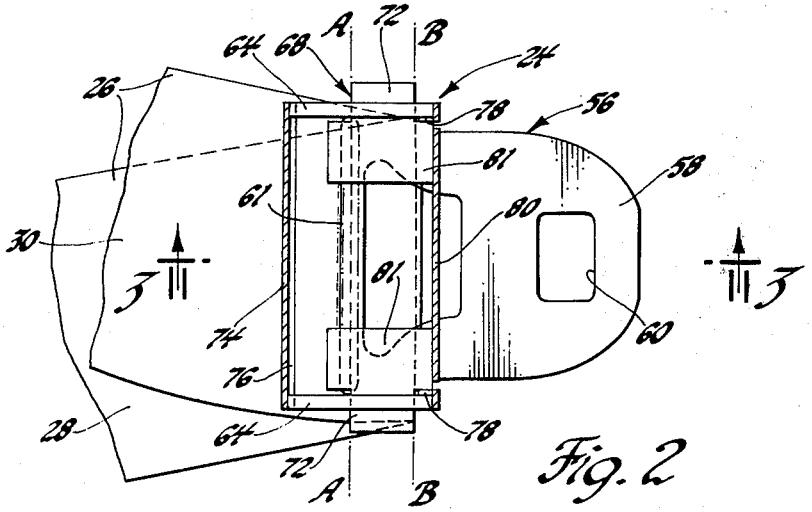
FIG. 2 is an enlarged view of the improved buckle component taken generally along the line 2—2 of FIG. 1 and illustrates that the buckle component shown is of the male D-ring type and is thus adaptable for insertion to within a complementary female buckle.
Figure 3:
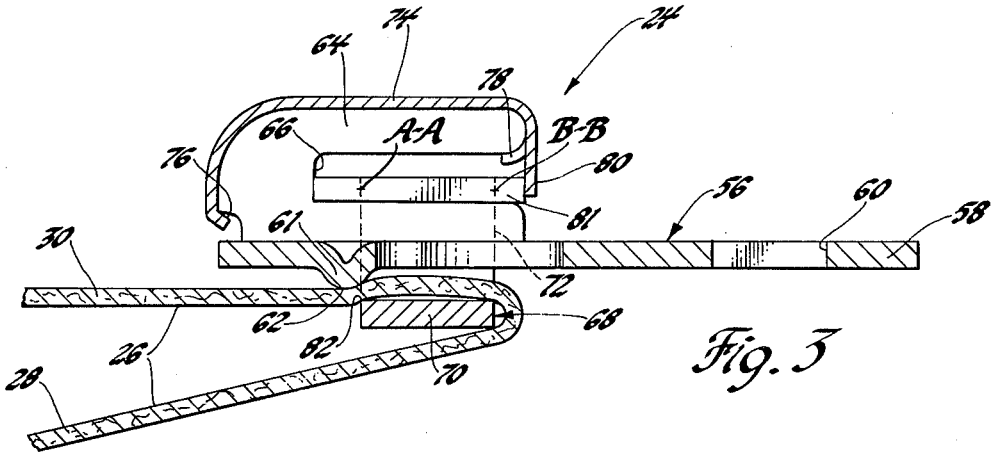
FIG. 3 is a sectional view of the buckle component shown in FIG. 2 and is taken along line 3—3 of FIG. 2.
Figure 4:
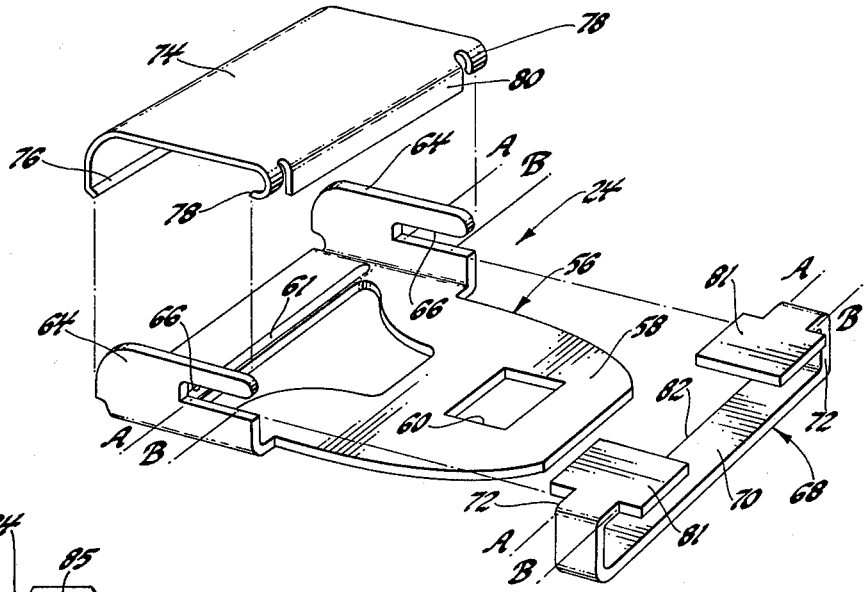
FIG. 4 is an exploded perspective view of the portions of the buckle component shown by FIGS. 1–3.

Referring additional to FIGS. 2 through 4, the buckle component 24 is illustrated as including a latch plate or housing 56 with a tongue 58 that is inserted into the buckle 44. A locking pawl, not shown, of the buckle is received by an aperture 60 in the tongue to secure the buckle component 24 in a conventional manner. This aperture 60 and the general configuration of the tongue 58 gives the housing 56 a configuration generally like that of the capital letter D, as best seen in FIG. 2, and is thus the reason this buckle component is referred to as a D-ring. At the opposite end of the housing 56 from tongue 58, as best seen in FIG. 3, the housing defines a downwardly projecting locking portion 61 that has a surface 62 facing outwardly with respect to the buckle component. This locking portion has a rectilinear configuration as can be seen in FIG. 4 and extends generally between the opposite sides of the buckle component so as to be located transversely with respect to the longitudinal direction of belt 26. Adjacent each end of locking portion 62, the housing 56 includes upwardly extending flange portions 64 that are located at 90° with respect to the plane of the tongue 58. These flange portions 64 define the total width of the buckle component housing 56 and this width is approximately equal to or less than the width of belt 26 as can be seen in FIG. 2. Also, the flange portions 64, as can be seen by referring to FIG. 4, define slots 66 that open toward the direction of the tongue 58 of housing 56.

The buckle component 24 also includes an external lock bar 68 having a rectilinear portion 70 extending alongside the locking portion 61. The belt 26 extends between the locking portion 61 of the buckle component and the rectilinear portion 70 of the lock bar as best seen in FIG. 3. The ends of the rectilinear portion 70 of the lock bar are indicated by 72 and have generally U-shaped configurations. These end portions extend about the opposite sides of the belt 26 back toward each other so as to be received by the slots 66 within the flange portions 64 of housing 56. These slots are of a larger width than the thickness of the end portion 72 so that the lock bar can pivot in a manner that will subsequently be described. A cover 74 of the buckle component 24 includes flanges 76 and 78, see FIG. 3, that snap over portions of the housing flange portions 64 so as to secure the cover to the buckle component housing 56. This cover also includes a positioning flange 80 which, as seen in FIG. 3, engages enlarged terminal ends 81 of the lock bar end portions 72. This engagement maintains the lock bar 68 in position on the housing 56.

Since the belt 26 assumes a rectilinear configuration in its phantom line indicated storage position shown by FIG. 1, the buckle component 24 is free to slide down the belt into engagement with the stop 54 positioned along the belt. A seated occupant desiring to utilize belt system 22 manually grasps the buckle component 24 and pulls the belt so that retractor 42 allows belt withdrawal and subsequent attachment of the buckle component 24 to the buckle 44. The lap belt portion 28 of the belt system may then be somewhat slack as it extends across the occupant's lap. To eliminate this slack, the occupant grasps the shoulder belt portion 30 of the belt and pulls on the shoulder belt portion with a manual effort. With a combined reference to FIGS. 1 and 3, it will be obvious that this shoulder belt pull will cause the lock bar 68 to pivot as a result of the looseness with which the end portion 72 are received within the slots 66 in flange portions 64. This pivoting takes place about an axis A—A, see also FIG. 4, extending generally between the ends of the lock bar at the closed ends of the flange slots 6 and is in a direction that moves the rectilinear portion 70 of the lock bar away from the outwardly facing surface 62 on the locking portion 61 of the housing 56. The belt 26 is then free to slide through the buckle component 24 between the locking surface 62 of the housing and an adjacent edge 82 on the rectilinear portion 70 of the lock bar. This eliminates the slackness in the lap belt portion 28 and thereby tensions the lap belt portion across the user of the belt system.

As the lap belt portion 28 becomes tensioned, it causes the lock bar 68 to pivot about an axis B—B, see FIGS. 3 and 4, that is parallel to axis A—A but located at the open ends of flange slots 66. This lock bar pivoting is in a direction that moves the edge 82 of the lock bar toward locking surface 62 of the housing. This direction is opposite to the direction the lock bar 68 pivots upon the pull of the shoulder belt and is due to the fact that the lap belt portion 28 is looped over the rectilinear portion 70 of the lock bar before passing between the locking surface 62 and the edge 82 of the lock bar. The edge 82 of the lock bar clamps the belt 26 against the locking surface 62 of the housing 56 when the lap belt portion 28 becomes tensioned to a certain degree. This clamping stops the belt from sliding through the buckle component 24 and the retractor 42 then stores the excess length of belt that then has moved to the shoulder belt portion side of the component 24 so that only the required amount of shoulder belt is present. Locking of the belt retractor 42 in response to abrupt vehicle acceleration or deceleration or in response to a sudden pull on the belt, both of which are well known modes of belt retractor locking, fixes the length of belt 26 to restrain a suddenly moved seated occupant.

As can be seen best by FIG. 2, the manner in which the end portions 72 extend around the side ends of the belt 26 permits the housing 56 to have a width that is equal to or less than the width of the belt, and gives the buckle component a compact construction. If the end portions of the lock bar did not extend back toward each other with their U-shaped configurations in the manner disclosed, such a narrow and compact belt component would not be possible. Also, when the belt system 22 is disposed in its occupant restraining position, the lap belt portion 28 and shoulder belt portion 30 are angularly disposed with respect to each other as shown by FIG. 2. Due to the external condition of this lock bar 68 with respect to the housing 56, the belt portions 28 and 30 are then able to extend with rectilinear configurations from their juncture at the rectilinear portion 70 of the lock bar.

Figure 5:
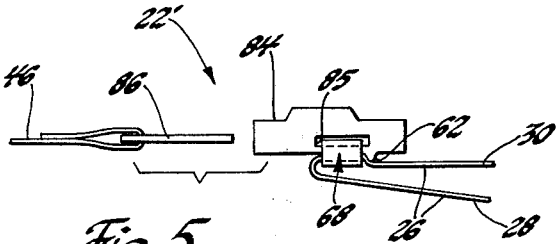
FIG. 5 is a schematic side view of an embodiment of the improved buckle component in which it takes the form of a female buckle that is capable of receiving and attaching a male D-ring to provide belt securement.

FIG. 5 discloses a belt system 22' that is similar to belt system 22 of FIGS. 1–4. However, this belt system has the external lock bar 68 mounted on a female buckle 84 instead of a male D-ring. The belt 26 is slidably received between the lock bar 68 and a locking surface 62 of the buckle housing to define the lap and shoulder belt portions 28 and 30. The lock bar 68 has end portions 72 that extend about the edges of belt 26 back toward each other so as to be received within slots 85 in the buckle housing. The lock bar 68 clamps the belt in the same way as the lock bar of the FIG. 1–4 embodiment previously described and permits the buckle housing to have a width equal to or less than the width of the belt. A male D-ring 86 secured to a belt 46 is received by the buckle 84 to secure the belt portions 28 and 30 in restraining positions.

Figure 6:
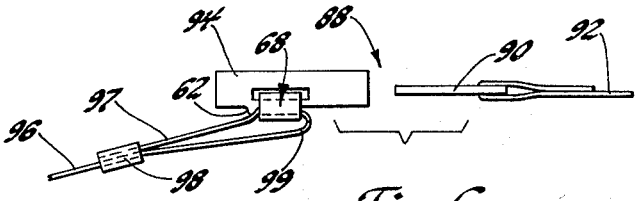
FIG. 6 is a schematic side view of an embodiment of the improved buckle component in which it takes the form of a female buckle and is located on the terminal end of a restraint belt instead of between the ends of the belt as with the two embodiments respectively shown by FIGS. 1–4 and 5.

FIG. 6 is a schematic view which shows another embodiment of a vehicle occupant restraint belt system generally indicated by numeral 88. This belt system includes a conventional male D-ring 90 through which a belt 92 is passed and then stitched to itself to provide securement of the D-ring. The belt system also includes a female buckle 94 which has an external lock bar 68 pivotally supported on it like the one shown and described in conjunction with FIG. 5. However, a portion of the belt 97 that provided shoulder belt portion 30 in the FIG. 5 embodiment does not perform a restraining function in this FIG. 6 embodiment. Rather, this belt portion 97 is fixedly secured to a slider 98 that slides along another portion 99 of the belt to form a belt loop of varying size. Adjustment of the size of the loop so formed adjusts the effective length of belt 96 and the effective length of the occupant encircling loop which belts 92 and 96 cooperatively provide with the male D-ring 90 attached to the female buckle 94. This belt loop is made larger by pulling on belt portion 97 in the same way the shoulder belt portion 30 was pulled in the FIG. 1–4 embodiment. Upon detachment of buckle 94 from D-ring 90, the belt portion 99 may be pulled in the opposite direction with respect to the buckle, to the right in FIG. 6, so as to make the loop smaller as the belt slides through the buckle. The effective length of the belt is longer when the loop is smaller and shorter when the loop is larger. Like the other embodiments, the width of the buckle 94 is the same or less than the belt width due to the configuration of the lock bar 68.

Figure 7:
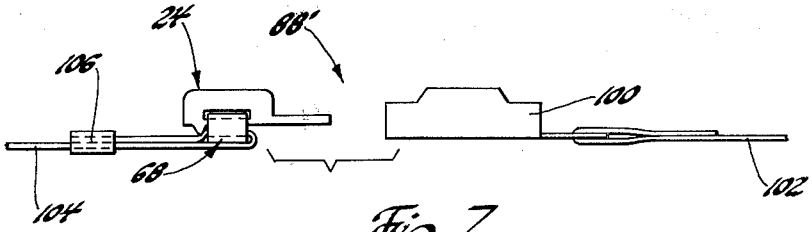
FIG. 7 is a schematic side view of an embodiment of the buckle component in which it takes the male D-ring form and is also located on the terminal end of a restraint belt like the female buckle embodiment of FIG. 6.

FIG. 7 shows another embodiment of a vehicle occupant restraint belt system that is indicated by numeral 88'. This belt system includes a female buckle 100 through which a belt 102 is looped and then stitched to itself. This belt system also includes a male D-ring buckle component 24 like the one shown by FIGS. 1 through 4. This buckle component 24 includes an external lock bar 68 over which a belt 104 is looped and then attached to a slider 106 along the belt. Adjustment of the length of the loop so formed, in the same manner described in conjunction with FIG. 6, adjusts the effective length provided by belts 102 and 104 when the male D-ring buckle component 24 is secured to the female buckle 100.

It should be noted that although the embodiments of the invention have shown the locking surfaces 62 of the buckle components as projecting in an abrupt fashion from the buckle component housings, such an abrupt projection is not necessarily required and a flat surface will function equally as well to provide the belt locking. However, the external lock bar 68 may be modified so that its end portions are slidably mounted instead of pivotally mounted on the buckle component and, in that instance, the locking surface 62 should be dislocated from the plane of the housing in order to give the bar a surface to lock against. However, with the pivoting bar, such an abruptly dislocated locking surface is not necessary.

The foregoing specification thus describes the improved vehicle occupant restraint belt system of the present invention.

What is claimed is:

1. In a vehicle occupant restraint belt system including a flat belt with an elongated configuration extending between upper and lower portions of the vehicle on one side of an associated seat, the belt having a predetermined width between opposite side edges thereof, a belt retractor receiving the upper end of the belt so as to store the belt and permitting withdrawal of the belt therefrom for use, and a fixed buckle component secured adjacent the other side of the seat, an improved sliding buckle component slidably disposed along the belt comprising: a metallic housing including an attachment portion for selectively securing the sliding buckle component to the fixed buckle component so the belt defines angularly disposed lap and shoulder belt portions, the housing also including a downwardly projecting rectilinear locking portion extending transversely with respect to the elongated direction of the belt with approximately the same length as the width of the belt, the housing having upwardly extending flange portions defining a slot at each side of the housing, an external lock bar having a rectilinear portion extending alongside the locking portion of the housing with the belt received therebetween, the lock bar having a slightly greater length than the width of the belt and the housing and having end portions extending from the rectilinear portion about the side edges of the belt back toward each other in generally U-shaped configurations, the end portions of the lock bar being loosely engaged in the slots at each side of the housing and having first and second side edges which alternatively provide a pivot axis for pivotal movement of the lock bar relative the housing so that a manually applied upward pull on the shoulder belt portion when the buckle components are secured to each other pivots the lock bar about the first side edge of the locking bar end portions and away from the locking portion and slides the belt through the buckle component between the lock bar and housing to tension the lap belt portion, this tension of the lap belt portion pivoting the lock bar about the second side edge of the locking bar end portions toward the downwardly projecting locking portion of the housing to clamp the belt at the juncture between the angularly disposed lap and shoulder belt portions, and the configuration of the lock bar and the manner it extends about the edges of the belt permitting the lap and shoulder belt portions to extend in generally rectilinear configurations from their juncture at the rectilinear portion of the lock bar as well as permitting the housing to have a width equal to or less than the width of the belt.

2. In a vehicle occupant restraint belt system including a flat belt with an elongated configuration extending between upper and lower portions of the vehicle on one side of an associated seat, the belt having a predetermined width between opposite side edges thereof, a belt retractor receiving the upper end of the belt so as to store the belt and permitting withdrawal of the belt for use, and a fixed female buckle secured adjacent the other side of the seat, an improved D-ring slidably disposed along the belt comprising: a metallic housing having a flat configuration with an apertured tongue that is received by the female buckle so the D-ring defines the belt into lap and shoulder belt portions that are angularly disposed with respect to each other, one side of the housing having a rectilinear surface extending transversely with respect to the elongated direction of the belt to provide a locking portion, the housing also including a pair of flange portions adjacent the opposite ends of the locking portions, the flange portions extending away from the plane of the housing in a direction opposite to the direction in which the one side of the locking portion faces, an external lock bar having a rectilinear portion extending alongside the locking portion of the housing with the belt received therebetween, the lock bar having a slightly greater length than the width of the belt and having end portions extending from the rectilinear portion about the side edges of the belt back toward each other on the other side of the housing, the end portions of the lock bar defining generally U-shaped configurations, and means pivotally interconnecting the end portions of the lock bar and the flange portions of the housing so the lock bar is pivotally movable toward and away from the locking portion of the plate, a manually applied upward pull on the shoulder belt portion when the D-ring is secured to the female buckle pivoting the lock bar away from the locking portion and sliding the belt through the D-ring to tension the lap belt portion, this tension of the lap belt portion pivoting the lock bar toward the locking portion of the housing to clamp the belt at the juncture of the lap and shoulder belt portions, and the configuration of the lock bar and the manner it extends about the edges of the belt permitting the lap and shoulder belt portions to extend in generally rectilinear configurations from their juncture at the rectilinear portion of the lock bar as well as permitting the housing to have a width equal to or less than the width of the belt.

* * * * *